US010480366B2

(12) United States Patent
Wyatt et al.

(10) Patent No.: US 10,480,366 B2
(45) Date of Patent: Nov. 19, 2019

(54) THROTTLED PCV SYSTEM FOR AN ENGINE

(71) Applicants: Colton Wyatt, Lake Orion, MI (US); Anthony J Han, Utica, MI (US)

(72) Inventors: Colton Wyatt, Lake Orion, MI (US); Anthony J Han, Utica, MI (US)

(73) Assignee: FCA US LLC, Auburn Hills, MI (US)

( * ) Notice: Subject to any disclaimer, the term of this patent is extended or adjusted under 35 U.S.C. 154(b) by 71 days.

(21) Appl. No.: 15/709,668

(22) Filed: Sep. 20, 2017

(65) Prior Publication Data

US 2019/0085743 A1 Mar. 21, 2019

(51) Int. Cl.

*F01M 13/02* (2006.01)
*F01M 13/04* (2006.01)
*F01M 13/00* (2006.01)

(52) U.S. Cl.

CPC ..... *F01M 13/021* (2013.01); *F01M 13/04* (2013.01); *F01M 2013/0044* (2013.01); *F01M 2013/027* (2013.01)

(58) Field of Classification Search

CPC ..... F01M 13/021; F01M 13/04; F01M 2013/0044; F01M 2013/027; F01M 2013/038; F02M 13/022

USPC ..... 123/572–574

See application file for complete search history.

(56) References Cited

U.S. PATENT DOCUMENTS 4,463,721 A * 8/1984 Hayashi ..... F02D 9/02 123/378
4,727,848 A * 3/1988 Stumpp ..... F02D 11/08 123/568.28
5,611,204 A 3/1997 Radovanovic et al.
6,123,061 A 9/2000 Baker et al.
7,886,727 B2 2/2011 Ulrey et al.
2008/0223347 A1* 9/2008 Hommes ..... F01M 13/022 123/572
2008/0295814 A1* 12/2008 Breuninger ..... F01M 13/022 123/572
2009/0090337 A1* 4/2009 Asanuma ..... F01M 13/022 123/574
2009/0301446 A1* 12/2009 Asanuma ..... F01M 13/028 123/559.1
2011/0277733 A1* 11/2011 Spix ..... F01M 13/023 123/574
2013/0118460 A1 5/2013 Lockard
2014/0076294 A1* 3/2014 Ulrey ..... F01M 13/022 123/572

(Continued)

*Primary Examiner* — Jacob M Amick
(74) *Attorney, Agent, or Firm* — Ralph E Smith

(57) ABSTRACT

A positive crankcase ventilation (PCV) system for an internal combustion engine includes a forced air induction system configured to supply air to the engine, a PCV line configured to fluidly couple between a crankcase of the engine and a clean side air duct of the forced air induction system, a make-up air (MUA) line configured to fluidly couple between the crankcase and the clean side air duct, and an inlet valve disposed in the forced air induction system. The inlet valve is configured to be controlled selectively move between an open position and a closed position to vary an air restriction in the forced air induction system and generate a vacuum. The vacuum draws blow-by gases from the crankcase through the PCV line and into the air induction system when the engine is under either naturally aspirated or boosted conditions.

18 Claims, 1 Drawing Sheet

(56) References Cited

U.S. PATENT DOCUMENTS

| | | | | |
|---|---|---|---|---|
| 2015/0053188 | A1* | 2/2015 | Kuribayashi | F02B 37/183 123/574 |
| 2015/0275719 | A1* | 10/2015 | Nakama | F01M 13/022 123/573 |
| 2015/0285111 | A1* | 10/2015 | Rollinger | F01M 13/00 123/559.1 |
| 2016/0251987 | A1* | 9/2016 | De Luca | F01M 11/10 123/573 |
| 2016/0312686 | A1 | 10/2016 | Christian et al. | |

* cited by examiner

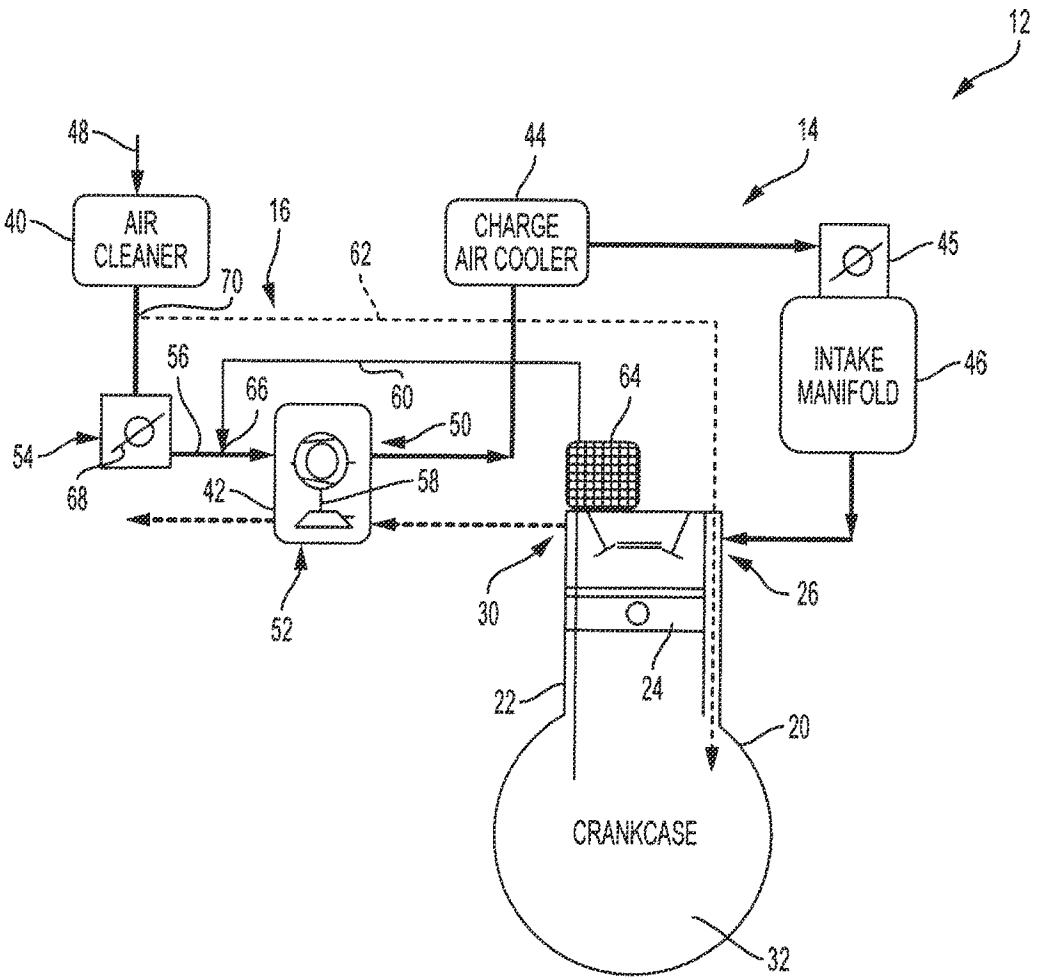
12
14
16
AIR CLEANER
40
48
70
CHARGE AIR COOLER
44
45
INTAKE MANIFOLD
46
62
60
50
58
52
66
56
54
68
42
64
30
26
24
22
20
CRANKCASE
32

THROTTLED PCV SYSTEM FOR AN ENGINE

FIELD

The present application relates generally to positive crankcase ventilation (PCV) systems for internal combustion engines and, more particularly, to a throttled PCV system for such engines.

BACKGROUND

Positive crankcase ventilation (PCV) systems are designed to evacuate blow-by gases from a crankcase of an internal combustion engine. These gases are formed of an air/fuel mixture that escapes the combustion chamber by "blowing by" the piston seals. To avoid corrosion and high pressures in the crankcase that can potentially damage the seals and increase pumping work, the blow-by gases must be vented therefrom. This is typically accomplished by returning the blow-by gases to the intake side of the internal combustion engine where the gases are mixed with the air/fuel mixture and subsequently burned. While PCV system gases generally flow through the intake manifold and rely on a make-up air (MUA) to flush out the crankcase with fresh air; under boost conditions, PCV flow is reversed in a MUA line. During such conditions, the MUA system no longer provides fresh air to the crankcase, but rather evacuates blow-by gases from the crankcase. As a result, additional components such as an oil separator are required. Thus, while current PCV systems work well for their intended purpose, it is desirable to provide a simplified PCV system with reduced cost and complexity.

SUMMARY

According to one example aspect of the invention, a positive crankcase ventilation (PCV) system for an internal combustion engine is provided. The PCV system includes, in one exemplary configuration, a forced air induction system configured to supply air to the engine, a PCV line configured to fluidly couple between a crankcase of the engine and a clean side air duct of the forced air induction system, a make-up air (MUA) line configured to fluidly couple between the crankcase and the clean side air duct, and an inlet valve disposed in the forced air induction system. The inlet valve is configured to be controlled to selectively move between an open position and a closed position to vary an air restriction in the forced air induction system and generate a vacuum. The generated vacuum is configured to draw blow-by gases from the crankcase through the PCV line and into the air induction system when the engine is under either naturally aspirated or boosted conditions, thereby facilitating preventing a reverse flow of blow-by gases into the MUA line and eliminating a need for an oil separator in the MUA line.

In addition to the foregoing, the described PCV system may include one or more of the following features: wherein the inlet valve is disposed in the forced air induction system upstream of a fluid connection between the PCV line and the clean side air duct; wherein the inlet valve is disposed in the forced air induction system downstream of a fluid connection between the MUA line and the clean side air duct; wherein the forced air induction system comprises a turbocharger; wherein the inlet valve is disposed in the forced air induction system upstream of the turbocharger; and wherein the inlet valve is disposed in the forced air induction system at a location downstream of a fluid connection between the MUA line and the clean side air duct, upstream of a fluid connection between the PCV line and the clean side air duct, and upstream of the turbocharger.

In addition to the foregoing, the described PCV system may include one or more of the following features: wherein the inlet valve is an electronically controlled throttle valve; wherein the inlet valve includes a biasing mechanism configured to bias the inlet valve to the open position; wherein the inlet valve is an electronically controlled solenoid valve; and wherein the PCV line includes an oil separator.

According to another example aspect of the invention, internal combustion engine is provided. The engine includes, in one exemplary configuration, a crankcase, a forced air induction system having an air supply duct, and a positive crankcase ventilation (PCV) system. The PCV system includes a PCV line fluidly coupled between the crankcase and air supply duct and configured to vent blow-by gases from the crankcase to the air supply duct, a make-up air (MUA) line fluidly coupled between the crankcase and the air supply duct, and an inlet valve disposed in the forced air induction system. The inlet valve is configured to selectively move between an open position and a closed position to vary an air restriction in the forced air induction system and generate a vacuum. The generated vacuum is configured to draw the blow-by gases from the crankcase through the PCV line and into the air induction system when the engine is under either naturally aspirated or boosted conditions, thereby facilitating preventing a reverse flow of the gases in the MUA line and eliminating a need for an oil separator in the MUA line.

In addition to the foregoing, the described engine may include one or more of the following features: wherein the forced air induction system includes a turbocharger; wherein the inlet valve is disposed in the forced air induction system upstream of a fluid connection between the PCV line and the air supply duct; wherein the inlet valve is disposed in the forced air induction system downstream of a fluid connection between the MUA line and the air supply duct; wherein the inlet valve is disposed in the forced air induction system upstream of the turbocharger; wherein the fluid connection between the PCV line and the air supply duct is disposed in the forced air induction system downstream of the inlet valve and upstream of the turbocharger; an oil separator disposed in the PCV line; and wherein the PCV system does not include a line fluidly coupled between the crankcase and the intake manifold to vent the blow-by gases.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

FIG. 1 is a schematic diagram of an example internal combustion engine having a PCV system, in accordance with the principles of the present disclosure.

DETAILED DESCRIPTION

The present application is directed to a positive crankcase ventilation (PCV) system of an internal combustion engine.

Typical PCV systems include a PCV line to vent blow-by gases from the crank case under naturally aspirated conditions, and a separate make-up air (MUA) line. Under boosted conditions, the crankcase gases are reversed and forced through the MUA line. Because of reversal of crankcase gases, the typical PCV system requires oil separators for each line, specifically designed PCV valves, and sensors to detect any disconnect in the lines, which adds to the complexity and number of components of the system.

The present disclosure provides an inlet valve to vary or throttle a restriction in the air induction system to create and maintain a vacuum level to support the evacuation of blow-by gases from the crankcase in both naturally aspirated conditions and boost conditions (e.g., supercharged or turbocharged), which greatly reduces the number of system components, and simplifies assembly thereof.

Referring now to the drawings, FIG. 1 is a schematic illustration of an internal combustion engine 12 that generally includes a forced air induction system 14 and a PCV system 16.

The engine 12 generally includes a cylinder head 20 defining one or more cylinders 22 to each receive a reciprocating piston 24 therein. An intake port 26 supplies an air/fuel mixture from the forced air induction system 14 to a combustion chamber 28 within the cylinder 22. The air/fuel mixture is ignited in the combustion chamber 28 and the resulting exhaust gas is removed from the chamber via an exhaust port 30. During the combustion, a portion of the exhaust gas can blow by the piston 24 into a crankcase 32 of the engine. As described herein in more detail, the PCV system 16 recirculates the blow-by gases back to the forced air induction system 14 for further combustion in the combustion chamber 28.

The forced air induction system 14 generally includes an air filter 40, a turbocharger 42, a charge air cooler 44, a throttle valve 45, and an intake manifold 46. Air enters the vehicle through an air intake 48 and is filtered in the air filter 40 before entering a compressor side 50 of the turbocharger 42. The air is compressed and subsequently cooled in the charge air cooler 44 before being delivered to the intake port 26 via the intake manifold 46. The throttle valve 45 is fluidly coupled to the intake manifold 46 and is configured to selectively restrict the amount of air introduced to the engine 12. After combustion, the exhaust gas is removed from the combustion chamber 28 through exhaust port 30 before being directed to a turbine side 52 of the turbocharger 42. The exhaust gas drives the turbine side 52, which drives the turbocharger compressor side 50 via a shaft 58, and the exhaust gas is subsequently supplied to a vehicle exhaust aftertreatment system (not shown).

However, in the example implementation, the forced air induction system 14 additionally includes an inlet valve 54 in a clean side air duct 56 upstream of the turbocharger 42. The inlet valve 54 is configured to vary or throttle the restriction in the clean side air duct 56 to create and maintain a vacuum level which supports the evacuation of blow-by gases from the crankcase 32 in both naturally aspirated and boost conditions, as described herein in more detail.

In the example embodiment, the PCV system 16 generally includes a PCV line 60 and an MUA line 62. The PCV line 60 is fluidly connected between the crankcase 32 and the clean side air duct 56 to vent blow-by gases from the crankcase 32 to the forced air induction system 14. The PCV line 60 includes an oil separator 64 configured to remove oil from the blow-by gases as they are directed from the crankcase 32 to the forced air induction system 14.

In the example embodiment, the inlet valve 54 is disposed in the forced air induction system 14 upstream of a junction or fluid connection 66 between the clean side air duct 56 and the PCV line 60. However, the inlet valve 54 may be disposed in the forced air induction system 14 in any suitable location that enables PCV system 16 to function as described herein. In one example, inlet valve 54 is an electronically controlled throttle valve that creates an additional drop in pressure in the air duct 56 to thereby draw blow-by gases from the crankcase 32 through the PCV line 60.

In one example, the inlet valve 54 includes a throttle body or restrictor plate 68 configured to move to various positions between and including fully open and fully closed positions. A biasing mechanism (not shown) such as a spring is configured to bias the inlet valve 54 open to protect the engine in the event of a hardware malfunction. As such, inlet valve 54 is electronically controlled to various positions to create a predetermined amount of vacuum by closing the restrictor plate 68. However, it will be appreciated that inlet valve 54 is not limited to a throttle valve and may be any suitable valve that enables PCV system 16 to function as described herein. For example, inlet valve 54 may be a solenoid valve.

The MUA line 62 is fluidly connected between the crankcase 32 and the clean side air duct 56 to provide make-up air to the crankcase 32 to replace the blow-by gases vented therefrom. As illustrated, the MUA line 62 is fluidly coupled to the clean side air duct 56 at a junction or fluid connection 70 disposed upstream of the inlet valve 54. Alternatively, the MUA line 62 may be coupled to an air cleaner of the vehicle.

Under both naturally aspirated and boosted conditions, a natural vacuum created by the air induction system 14 as well as the added vacuum created by the inlet valve 54 draws blow-by gases from the crankcase 32 through the PCV line 60 to the clean side air duct 56. The MUA line 62 is fluidly coupled to the clean side air duct 56 upstream of the inlet valve 54 in a higher pressure zone, so MUA is drawn through MUA line 62 to the crankcase 32 to replace the vented blow-by gases. In this way, MUA line 62 introduces fresh air into the crankcase 32 to flush out NOx and limit the vacuum level in the crankcase 32 to maintain peak pumping efficiency. Accordingly, inlet valve 54 is moved to a position to create an additional pressure drop or vacuum in the area upstream turbocharger 42 and proximate the fluid connection 66. The inlet valve 54 can be electronically controlled to maintain a predetermined vacuum during a wide range of boosted or naturally aspirated conditions. As such, the vacuum draws blow-by gases from the crankcase 32, through the PCV line 60, and back into the forced air induction system 14 where it is subsequently reburned in the combustion chamber 28.

Accordingly, in the example implementation, PCV system 16 provides a single ventilation route (i.e., PCV line 60) to vent blow-by gases from the crankcase 32 under both naturally aspirated and boosted conditions. As such, PCV system 16 requires fewer parts than typical systems that require a first line for ventilation under naturally aspirated conditions, and a separate second line for ventilation under boosted conditions. Accordingly, PCV system 16 does not require a PCV line between the crankcase and the intake manifold, or an oil separator or PCV valve that would typically be located thereon. However, one or more valves (not shown) may be utilized to regulate flow within the PCV line 60.

Moreover, since the PCV line 60 is a dedicated line for the blow-by gas venting, only the PCV line 60 requires additional diagnostic components (e.g., sensors) to detect if the line 60 is disconnected from the clean side duct 56 of the forced air induction system 14. Unlike typical forced induction systems that experience a reversal of flow in the MUA line under boosted conditions, the MUA line 62 is only utilized for make-up air. As such, MUA line 62 does not require diagnostic components that would be required on MUA lines that experience the flow reversal under boosted conditions.

Described herein are systems and methods for a PCV system that utilizes only a single PCV line for venting of blow-by gases from the crankcase under either boosted or naturally aspirated conditions. The systems include providing an inlet valve in the forced air induction system to vary or throttle the restriction therein. This enables creating and maintaining a vacuum level in the forced air induction system to facilitate the evacuation of blow-by gases from the crankcase in both the boosted and naturally aspirated conditions. Moreover, the system enables greater blow-by evacuation at higher engine speeds where more blow-by occurs. As such, the described PCV system reduces the number of components and diagnostics required for venting of blow-by by gases.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. A positive crankcase ventilation (PCV) system for an internal combustion engine, the PCV system comprising:

a forced air induction system configured to supply air to the engine;

a PCV line configured to fluidly couple between a crankcase of the engine and a clean side air duct of the forced air induction system;

a make-up air (MUA) line configured to fluidly couple between the crankcase and the clean side air duct, wherein the MUA line does not include a flow control valve thereon; and an inlet valve disposed in the forced air induction system, the inlet valve configured to be controlled to selectively move between an open position and a closed position to vary an air restriction in the forced air induction system and generate a vacuum, wherein the generated vacuum is configured to draw blow-by gases from the crankcase through the PCV line and into the air induction system when the engine is under either naturally aspirated or boosted conditions, thereby facilitating preventing a reverse flow of blow-by gases into the MUA line and eliminating a need for an oil separator in the MUA line.

2. The PCV system of claim 1, wherein the inlet valve is disposed in the forced air induction system upstream of a fluid connection between the PCV line and the clean side air duct.

3. The PCV system of claim 1, wherein the inlet valve is disposed in the forced air induction system downstream of a fluid connection between the MUA line and the clean side air duct.

4. The PCV system of claim 1, wherein the forced air induction system comprises a turbocharger.

5. The PCV system of claim 4, wherein the inlet valve is disposed in the forced air induction system upstream of the turbocharger and is configured to create an additional pressure drop in the area upstream of the turbocharger.

6. The PCV system of claim 4, wherein the inlet valve is disposed in the forced air induction system at a location downstream of a fluid connection between the MUA line and the clean side air duct, upstream of a fluid connection between the PCV line and the clean side air duct, and upstream of the turbocharger.

7. The PCV system of claim 1, wherein the inlet valve is an electronically controlled throttle valve.

8. The PCV system of claim 1, wherein the inlet valve includes a biasing mechanism configured to bias the inlet valve to the open position.

9. The PCV system of claim 1, wherein the inlet valve is an electronically controlled solenoid valve.

10. The PCV system of claim 1, wherein the PCV line includes an oil separator.

11. A vehicle comprising:

an internal combustion engine having an intake manifold and a crankcase;

a forced air induction system having an air supply duct fluidly coupled to the intake manifold;

a positive crankcase ventilation (PCV) system comprising:

a PCV line fluidly coupled between the crankcase and air supply duct and configured to vent blow-by gases from the crankcase to the air supply duct;

a make-up air (MUA) line fluidly coupled between the crankcase and the air supply duct; and an inlet valve disposed in the forced air induction system, the inlet valve configured to selectively move between an open position and a closed position to vary an air restriction in the forced air induction system and generate a vacuum, wherein the generated vacuum is configured to draw the blow-by gases from the crankcase through the PCV line and into the air induction system when the engine is under either naturally aspirated or boosted conditions, thereby facilitating preventing a reverse flow of the blow-by gases in the MUA line and eliminating a need for an oil separator in the MUA line; and a throttle valve fluidly coupled to the intake manifold and configured to selectively restrict the amount of air introduced to the internal combustion engine.

12. The vehicle of claim 11, wherein the forced air induction system includes a turbocharger.

13. The vehicle of claim 12, wherein the inlet valve is disposed in the forced air induction system upstream of a fluid connection between the PCV line and the air supply duct.

14. The vehicle of claim 13, wherein the inlet valve is disposed in the forced air induction system downstream of a fluid connection between the MUA line and the air supply duct.

15. The vehicle of claim 14, wherein the inlet valve is disposed in the forced air induction system upstream of the turbocharger.

16. The vehicle of claim 15, wherein the fluid connection between the PCV line and the air supply duct is disposed in the forced air induction system downstream of the inlet valve and upstream of the turbocharger.

17. The vehicle of claim 11, further comprising an oil separator disposed in the PCV line.

18. The vehicle of claim 11, wherein:

the PCV system does not include a line fluidly coupled between the crankcase and the intake manifold to vent the blow-by gases;

the throttle valve is disposed in the air supply duct at a location upstream of the intake manifold and downstream of the inlet valve; and the MUA line does not include a flow control valve thereon.

* * * * *